United States Patent [19]

Baggs

[11] 4,314,495

[45] Feb. 9, 1982

[54] PIEZOELECTRIC SADDLE FOR MUSICAL INSTRUMENTS AND METHOD OF MAKING SAME

[76] Inventor: Lloyd R. Baggs, 316 1/2 W. Pico Blvd., Los Angeles, Calif. 90015

[21] Appl. No.: 92,582

[22] Filed: Nov. 8, 1979

[51] Int. Cl.[3] ..... G10H 3/18

[52] U.S. Cl. ..... 84/1.16; 84/DIG. 24

[58] Field of Search ..... 84/1.14, 1.16, DIG. 24

[56] References Cited

U.S. PATENT DOCUMENTS

| | | | |
|---|---|---|---|
| 2,222,057 | 11/1940 | Benioff | 84/1.16 |
| 3,049,958 | 8/1962 | Benioff | 84/1.16 |
| 3,073,203 | 1/1963 | Evans | 84/1.16 |
| 3,080,785 | 3/1963 | Evans | 84/1.16 |
| 3,137,754 | 6/1964 | Evans | 84/1.16 |
| 3,154,701 | 10/1964 | Evans | 84/1.16 X |
| 3,178,501 | 4/1965 | Evans | 84/1.14 |
| 3,291,887 | 12/1966 | Carman et al. | 84/1.16 |
| 3,301,936 | 1/1967 | Carman et al. | 84/1.16 |
| 3,325,580 | 6/1967 | Barcus et al. | 84/1.16 |
| 3,396,284 | 8/1968 | Scherer | 84/DIG. 24 |
| 3,453,920 | 7/1969 | Scherer | 84/1.16 |
| 3,465,086 | 9/1969 | Borell | 84/1.16 |
| 3,507,972 | 4/1970 | Sebok | 84/1.14 |
| 3,519,721 | 7/1970 | Martin et al. | 84/1.14 |
| 3,530,228 | 9/1970 | Scherer | 84/1.16 |
| 3,600,497 | 8/1971 | Zanessi | 84/1.14 |
| 3,602,627 | 8/1971 | McCammon | 84/1.16 |
| 3,624,264 | 11/1971 | Lazarus | 84/1.14 |
| 3,712,951 | 1/1973 | Rickard | 84/1.14 |
| 3,733,425 | 5/1973 | Chaki | 84/1.14 |
| 4,030,396 | 6/1977 | Mariner | 84/1.16 |
| 4,147,084 | 4/1979 | Underwood | 84/1.16 |

*Primary Examiner*—S. J. Witkowski

*Attorney, Agent, or Firm*—John E. Reilly

[57] ABSTRACT

A piezoelectric crystal transducer defines a unitary part of a low profile saddle member adapted for interchangeable mounting in the bridge portion of a stringed musical instrument while obviating external modification of the instrument itself. In a preferred embodiment of the present invention, the body of the saddle is molded or potted around elongated piezoelectric crystalline bar segments to form a unitary saddle in which the bar segments traverse the substantial length of the saddle in a direction transversely of the extension of the strings over the saddle with hook-up leads or wires extending from one end of the bar for connection to a suitable cable leading to a conventional amplifier or loudspeaker system. The transducer is constructed to respond to stresses produced by string vibrations in one or more dimensions yet is completely shielded from external electrical fields and minimizes interference with the acoustical circuit of the instrument.

24 Claims, 9 Drawing Figures

PIEZOELECTRIC SADDLE FOR MUSICAL INSTRUMENTS AND METHOD OF MAKING SAME

This invention relates to a novel and improved transducer for acoustical instruments; and more particularly relates to a piezoelectric crystal transducer and the method of forming same as a saddle accessory for stringed instruments, such as, guitars in such a way that the saddle unit is interchangeable and readily replaceable without modification of the instrument itself.

BACKGROUND OF THE INVENTION

The classic guitar includes a sound box which is covered by a soundboard and has an elongated neck which carries a finger board and tensioning device at its free end for adjusting the frequency or pitch of the strings. A bridge portion is provided on the soundboard to permit mounting of a saddle over which the guitar strings are trained, and the ends of the guitar strings opposite to the tensioning device are suitably anchored by an anchor bar affixed to the soundboard. In the conventional acoustic guitar, sounds may be amplified by incorporating an electrical pick-up or transducer into the soundboard. Generally, in the past this has been done by adhering a wafer-type transducer under or adjacent to the bridge either in the original construction of the instrument or as a replacement or accessory, and is typically referred to as a body or contact transducer; or an alternate approach has been to place a number of individual transducers under the saddle in a bridge especially constructed for that purpose during original construction.

The generation of electrical signals by an electromechanical transducer is a well understood phenomenon. For instance, a piezoelectric ceramic transducer is a polarized synthetic crystal which emits a small voltage across the electrodes when it is subjected to stress, such as, the stress produced by vibration of the instrument strings. The piezoelectric crystal is so designed as to have a lattice oriented in such a way as to be polarized, and the stress imparted to the lattice alters its electrical potential so as to emit a corresponding voltage across the electrodes. Since the lattice is so oriented, the crystal is more sensitive to string vibrations which create stress in the direction of polarization.

Particular problems have been associated with electronic amplification of acoustical instruments. When a transducer is attached to the body of the guitar, such as, the sound box or sound board, the tonal qualities of the instrument are substantially retained. However, the disadvantage of this approach to electronic amplification is that there is both reduced sensitivity of the pickup unit and amplification of unwanted sounds resulting from taps or thumps on the body of the instrument as well as string squeak, and such unit is especially susceptible to feedback making it very difficult to achieve enough sound level or loudness to play to large audiences. This is due at least in part to the top itself acting as a receiver of sympathetic resonances from the loudspeakers. Where vintage instruments are concerned, the attachment of a transducer device may be troublesome since it may require the drilling or cutting of mounting holes in the instrument or other alterations thereto. The present invention avoids these problems by providing a sensitive piezoelectric transducer formed as part of an interchangeable saddle member which may be directly mounted in the original saddle slot of the bridge of the instrument. This invention therefore combines the best qualities of both the contact transducer which is attached directly to the sound board and the string transducer which underlies the instrument strings.

Various approaches have been taken in the installation of piezoelectric transducers to meet the problems associated with electronic amplification of an acoustical or stringed instrument, but generally can be characterized as requiring either that the transducer be mounted under the bridge or in a specially constructed bridge to receive the elements, making it necessary to purchase the instrument with the device already installed at the factory. For example, U.S. Pat. No. 3,712,951 issued Jan. 23, 1973 to Rickard discloses a special bridge assembly which has a number of individual piezoelectric transducers corresponding to the number of strings of the instrument. By utilizing individual transducers, cross-coupling of the strings is minimized, and the sympathetic resonance of the entire set of strings as well as the soundbox is thereby limited, and may alter the fullness of tone generated by the instrument. U.S. Pat. Nos. 3,396,284 and 3,530,228 to Scherer also disclose individual transducers corresponding to individual strings of the instrument wherein the crystals are isolated from one another and employ acoustical damping in an attempt to damp out undesirable highs, thumps and finger noise. Units of the type described above are generally acknowledged in the trade as the heretofore most versatile and popular units. This is due primarily to the cleanliness of tone resulting from the individual elements, lack of cross-coupling and relative absence of feedback. A drawback to this approach is that the quality or fidelity of the sound must be sacrificed and has posed certain problems heretofore in mounting and adaptation to existing guitars.

U.S. Pat. No. 3,507,972 utilizes an elastic material between the saddle and bridge components of the assembly to acoustically damp the saddle from the soundboard of the instrument. The elastic material places the transducer under compression so as to increase the output for a given amplitude of vibratory motion; however the elastic material absorbs the vibratory energy of the string which would reduce sustain times for a given note. Further, the amplified tone would have a quick rise time due to rapid absorption of string energy which would not be compatible with the tones expected to be produced by a non-amplified acoustical instrument.

U.S. Pat. No. 3,291,887 to Carman et al discloses a transducer element placed in an open gap of a saddle so that relative movement between opposing walls of the gap supporting the piezoelectric crystal cause it to be compressed to produce a modulated electric signal that may be amplified. Other patents such as U.S. Pat. No. 3,325,580 to Barcus et al and U.S. Pat. No. 4,147,084 to Underwood disclose violin bridges wherein the wings of the bridge are split with piezoelectric crystals being placed in the split wing so that it is sensed as the bridge vibrates. These devices naturally suppress the acoustic sound due to the crystal impeding the bridge wing motion.

A three-dimensional transducer is disclosed in U.S. Pat. No. 3,624,264 to Lazarus which is provided with three transducer crystals mounted on mutually perpendicular interior walls of the transducer assembly. This assembly is then filled with silicone rubber and attached directly to the soundboard of the instrument. While this transducer does not interfere with the acoustic circuit of the instrument, as is often the case with many other prior art devices, it does not possess high sensitivity, for two reasons. As noted above, the transducer is placed on a part of the body of the instrument, such as the soundboard, and hence is removed some distance from the point of string vibration and amplifies only the vibration sensed on the soundboard; and secondly, the piezoelectric crystals are not responsive to direct tension or compression but rather rely on compression as a result of the inertial mass of the transducer.

SUMMARY OF THE INVENTION

It is therefore an object of the present invention to provide for a novel and improved electromechanical transducer which defines a unitary part of a saddle for stringed instruments.

Another object of the present invention is to provide for a piezoelectric saddle and method of making same for stringed musical instruments which is specifically adaptable for use as an acoustic guitar bridge saddle amplification system in which the saddle is readily interchangeable or replaceable for existing saddles of the instrument without modification of the instrument itself.

A further object of the present invention is to provide for a piezoelectric saddle incorporating one or more transducers as a unitary part thereof in one or more dimensions, respectively, which achieves intrastring coupling and acts as the medium through which vibrations of the strings are passed on to the body in such a way as to enhance the tonal qualities of the instrument.

It is a further object of the present invention to provide for a piezoelectric transducer which combines the best qualities of contact and string transducers and is interchangeable with and readily substituted for the saddles of existing guitars without requiring external modification of the guitar.

In accordance with the present invention, there has been devised a piezoelectric saddle and method of making same which is specifically adaptable for use as a part of a guitar bridge saddle amplification system. The saddle incorporates as a unitary part thereof an elongated transducer in the form of a polarized synthesized crystal bar or bars extending the substantial length of the saddle portion transversely of the guitar strings and having electrical leads or electrodes extending from one end of the crystal for connection into a conventional amplification system. The transducer operates as a passive element in that it vibrates in direct response to vibration of the strings and is affected by sympathetic resonances so that the standing wave formed in the instrument is substantially unaffected. By utilizing elongated polarized ceramic bar members in end-to-end relation as a unitary part of the saddle, mechanical or intrastring cross-coupling is maintained and the transducer acts as the medium through which vibrations are transmitted to the body of the guitar. It not only senses direct string radiation but receives information from the body against which it acts without detracting from the tonal character of the instrument.

In an alternate form of a single dimensional transducer pick-up, a single elongated polarized ceramic bar extends the full length of the saddle so as to subtend the strings of the stringed instrument and has electrodes of opposite polarity on opposed top and bottom surfaces of the bar with positive and negative hookup wires connected to the electrodes. Either in the preferred or alternate form as described, the ceramic bar or bar segments as the case may be are encapsulated within a first insulating layer and a second shielding layer and are further encapsulated by potting or molding an epoxy resin in outer surrounding relation to the transducer, the mold being formed in the desired shape of the body of the saddle. As a further alternative, either form of transducer as described may be inserted into a channel or slot of a pre-formed saddle body; and once so inserted into the slot is integrated into the body by filling the remainder of the cavity with an epoxy resin.

In still another embodiment of the present invention, either the single or multiple ceramic bar segments comprising the transducer may be utilized in combination with a plurality of wafer-like crystals extending in end-to-end relation to one another and in spaced orthogonal relation to the transducer bar or bar segments, the wafer-like crystals being electrically interconnected and also connected to one of the electrodes of the bar or bar segments with the polarity of the respective transducer elements being selected to enhance the tonal properties of the instrument, increase signal-to-noise ratio and minimize interference from undesired noises from the soundboard itself.

The above and other objects, advantages and features of the present invention will become more readily appreciated and understood from the foregoing detailed description of a preferred embodiment when taken together with the accompanying drawings, in which:

DETAILED DESCRIPTION OF THE PREFERRED EMBODIMENT

Figure 1:
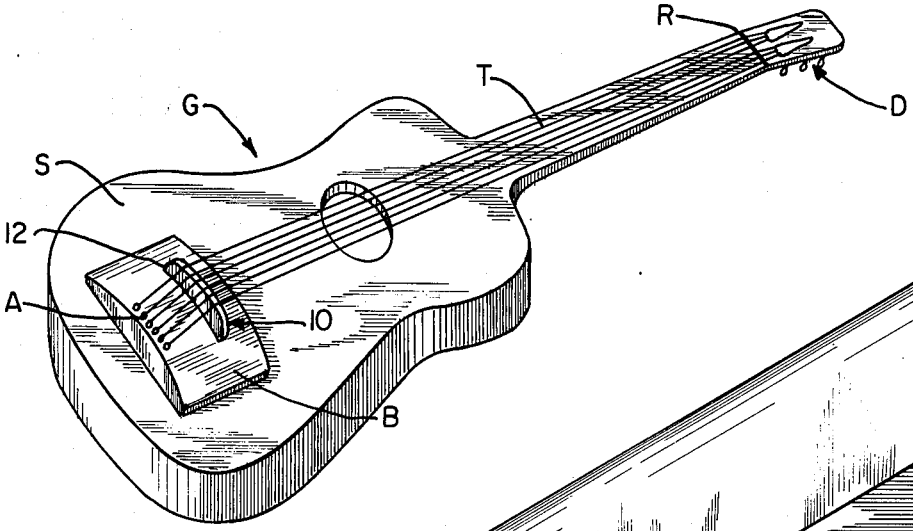
FIG. 1 is a perspective view of a preferred form of saddle and bridge assembly according to the present invention shown attached to a guitar soundboard.

Referring in detail to the drawings, an electrical pick-up for a stringed instrument takes the form of a piezoelectric transducer wherein the stresses produced by the vibrations of the strings are converted to an electrical potential or signal appropriate for amplification. As a setting for the present invention, and as shown in FIGS. 1 to 4, a conventional type of acoustic guitar is represented at G and is comprised of a soundboard S and a bridge assembly B. A plurality of guitar strings T are trained over the bridge assembly B and are secured at one end to an anchor bar or individual anchor points as represented at A; and the opposite ends of the strings pass over a ridge R then are attached to a tuning device as broadly designated at D which regulates the vibrational frequency or pitch of the strings. In accordance with the present invention, a low-profile saddle 10 is adapted for interchangeable mounting in a slot L formed in the bridge assembly B such that the strings T are trained over the upper edge of the saddle 10 so that the stresses produced by vibration of the strings are sensed by the saddle and converted to an electrical potential as earlier described.

The preferred form of saddle 10 is broadly comprised of an elongated outer body 12 extending transversely of the strings and having an internal cavity or recess 14 in which is positioned a piezoelectric transducer 16. Customarily, the outer body of the saddle is composed of a material selected to lend to the development of specific tones; and in the past has been made up of various materials such as, bone, graphite, aluminum, silver, brass, plastic, or wood. For reasons to be hereinafter discussed, the outer body 12 is preferably composed of a resinous plastic material such as an epoxy compound; for example, a preferred form of material is a Hysol 1 C or Hysol C9-4215/HD3561 which are manufactured and sold by The Dexter Corporation of Industry, Calif. The body 12 is molded in a manner to be described into an elongated rigid member so as to provide an upper string support surface 18 having a gently curving or convex arc along its length and also being transversely rounded into a more sharply curving arc normal to its length. The upper surface is also formed so as to taper upwardly from straight sides 19 and opposite end surfaces 20. The cavity 14 extends through the entire length of the body adjacent to its lower end or bottom surface. In this way, the cavity is surrounded by relatively thin sidewalls 23, a bottom wall 24 and a relatively thick upper body portion 25.

An important feature of the present invention resides in the construction of the piezoelectric transducer 16 which is in the form of an elongated or oblong bar assembly 30 composed of a piezoelectric or polarized ceramic material and sized for insertion into the cavity 14 so as to extend the substantial length of the body 12. The oblong bar 30 is preferably divided into an intermediate relatively long bar section 31 and end bar segments 32 at opposite ends of the intermediate bar 31. Bar segments 31 and 32 are of corresponding cross-sectional size and are generally rectangular in cross-section with the end bar segments 32 being disposed in closely-spaced relation to the opposite ends of the intermediate bar 31 so as to leave a slight spacing or gap 33 therebetween. The bar segments 31 and 32 are correspondingly formed of a piezoelectric crystalline material, such as, lead/zirconate-lead/titanate or barrium titanate which is sold by Gulton Industries, of Fullerton, Calif. and have electrodes of the polarities indicated which extend along opposite top and bottom surfaces. The bar segments 31 and 32 are interconnected by brass shim contact strips 34 and 35 which extend along the top and bottom electrode surfaces, respectively, of the bar segments 31 and 32 and are adhered to the bar segments under pressure with a bonding agent, such as, Hysol RA2038/HD3404 mixed with 25% by volume of a fine copper powder. A miniature two-conductor-shielded hook-up wire 38 has positive and negative leads 39 and 39' soldered or otherwise securely affixed to the shim contacts 34 and 35 at one end of the transducer. For this purpose, the ends of the shim contacts 34 and 35 preferably project beyond the ends of the bar segment 32 to facilitate attachment of the leads to the inner surfaces of the contacts.

Figure 2:
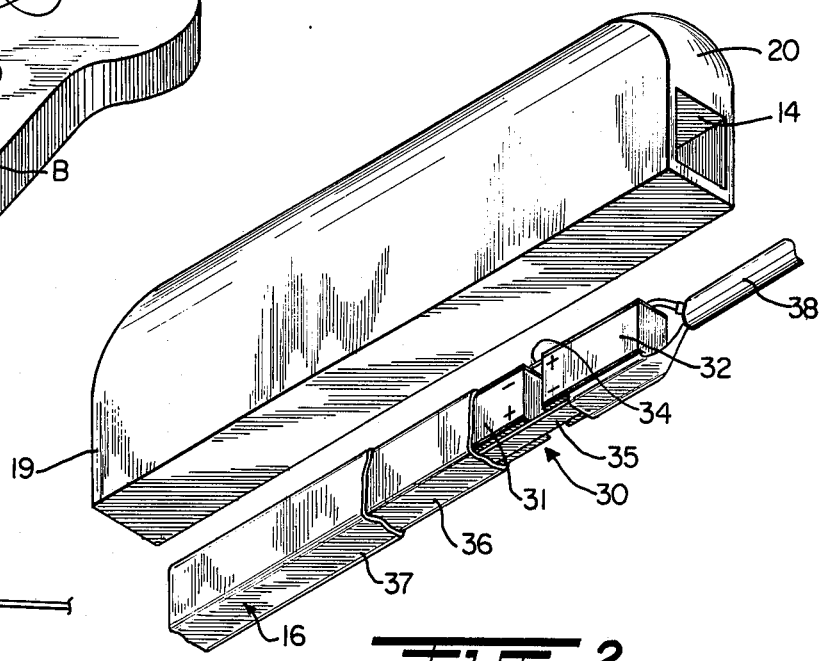
FIG. 2 is an exploded view in perspective of the preferred form of saddle and piezoelectric transducer prior to final assembly and showing a piezoelectric transducer assembly partially broken away.
Figure 4:
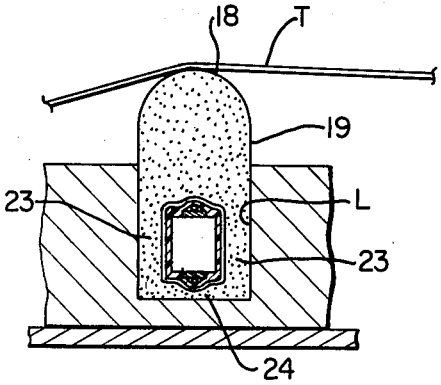
FIG. 4 is a cross-sectional view taken about lines 4—4 of FIG. 3.
Figure 3:
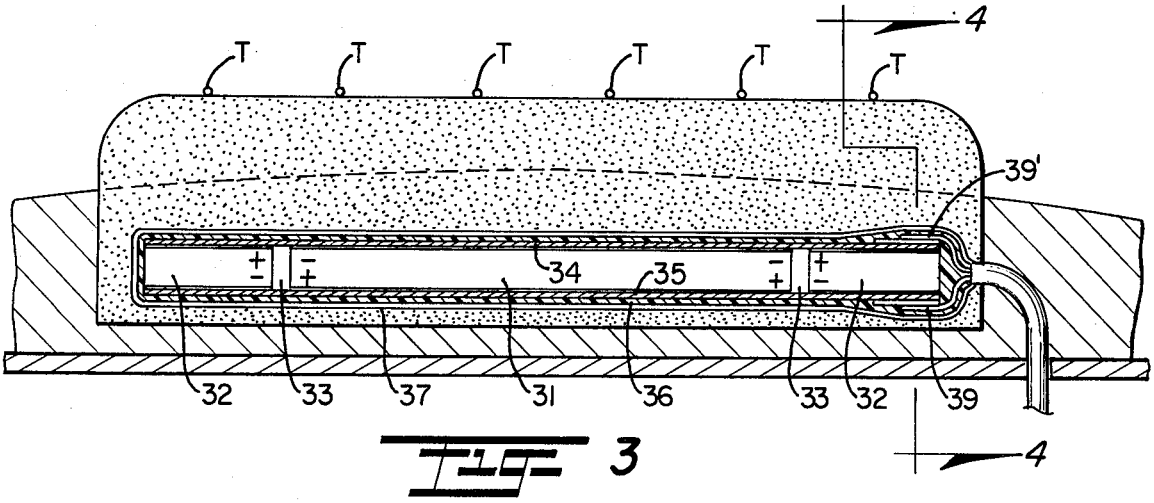
FIG. 3 is a longitudinal section view of the preferred form of transducer saddle and bridge assembly shown attached to the guitar soundboard according to the present invention.

The entire transducer is spray-coated with an insulating layer 36 which may preferably take the form of a Hysol PC17STD. printed circuit coating mixed 20% by volume with No. 325 Snow White mica powder. This may be applied in a film thickness on the order of 0.003" to 0.005". Thereafter, the negative lead wire is scraped of insulation until bare near the solder connection and the entire transducer then coated with a shielding layer 37, such as, GC Electronic Silver Print or Hysol K7-5224 which is capable of forming a 100% RF shield. The polarity of the bar segments is as illustrated in FIGS. 2 and 3 and by integrating the elements of the transducer assembly as described, will form essentially a unitary bar member traversing substantially the entire length of the saddle as specifically illustrated in FIG. 3. In order to preserve the integrity and unitary relation between elements comprising the transducer, preferably the body 12 is potted or otherwise molded into surrounding relation to the transducer 16. This may be done by placing the transducer assembly 16 as described in a mold having an open slot of the desired saddle dimensions with an exit hole in one end for the conductor wire. Suitable spacers are employed to locate the transducer assembly within the lower portion of the mold so as to leave a uniform spacing between the sides and bottom surface for flow of the epoxy resin in forming the sidewalls 23 and bottom wall 24.

Bridge saddles are conventionally formed in different standard sizes and to some extent are interchangeable. Although length and height may vary somewhat, the width is somewhat standardized to three dimensions, namely, 0.080", 0.090", or 0.125". For a saddle having a desired width of 0.125", for the purpose of illustration and not limitation, the entire length of the saddle may be on the order of 2.75" and its height on the order of 0.4". The bar segments 31 and 32 may have a total length of 2.3" with the intermediate bar segment being on the order of 1.25" and the end bar segments on the order 0.5", leaving a gap or spacing 33 on the order of 410.025". The thickness of the walls 23 and 24 may be on the order of 0.050" and the height of the bar segments 31 and 32 on the order of 0.100" with a width of 0.062". The transducer 16 is centered within the saddle so as to be positioned beneath the strings T which extend across the upper surface 18 of the saddle in substantially equally spaced relation to one another. The unitary saddle assembly as described thus affords interstring coupling and acts as the medium through which vibrations are passed from the body 12 into the transducer 16. The saddle is not only capable of picking up direct string vibration, but receives information from the body of the bridge against which it is positioned without distorting the tone. In this sense, the saddle assembly as described combines the best qualities of a contact transducer and string transducer while being interchangeable with existing saddles and obviates modifying of the instrument itself. Further, no elastic damping material is used between the bridge and saddle since any such damping material would have the effect of muffling the sound and would tend to absorb string energy and reduce tone sustain times.

Although a single bar 30 could be employed in place of the segmental bar as described, the segmental bar enables the use of bar segments 32 at opposite ends of the intermediate bar 31, which are of opposite polarity as illustrated, so as to greatly minimize objectionable soundboard noises which would otherwise interfere with the sounds produced by string vibration.

DETAILED DESCRIPTION OF MODIFIED FORM OF INVENTION

Figure 6:
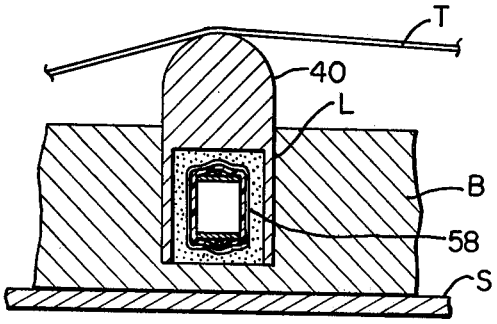
FIG. 6 is a cross-sectional view of the assembled transducer saddle shown in FIG. 5.
Figure 5:
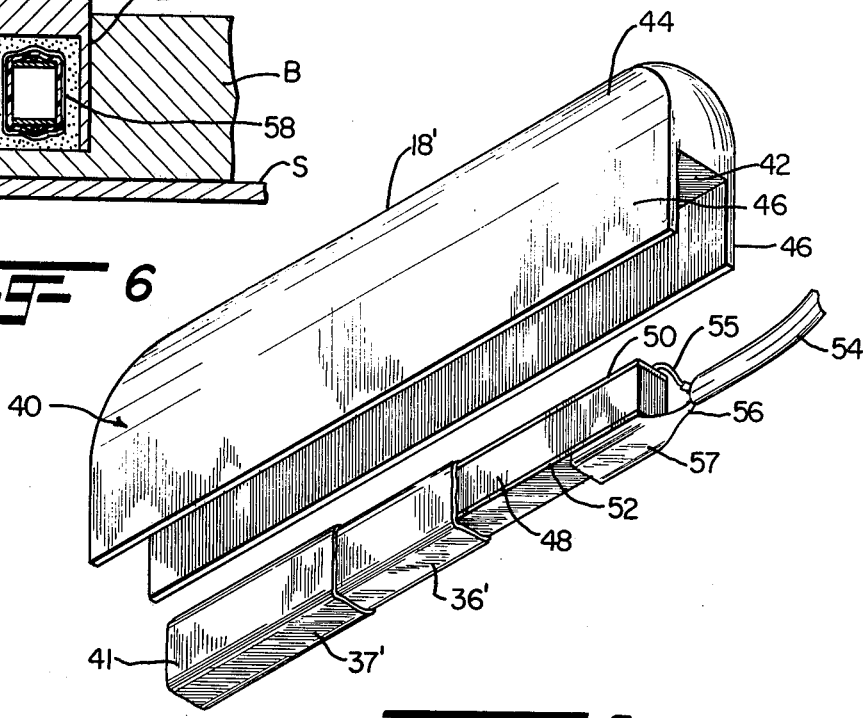
FIG. 5 is an exploded, somewhat perspective view of an alternate embodiment of the present invention.
Figure 7:
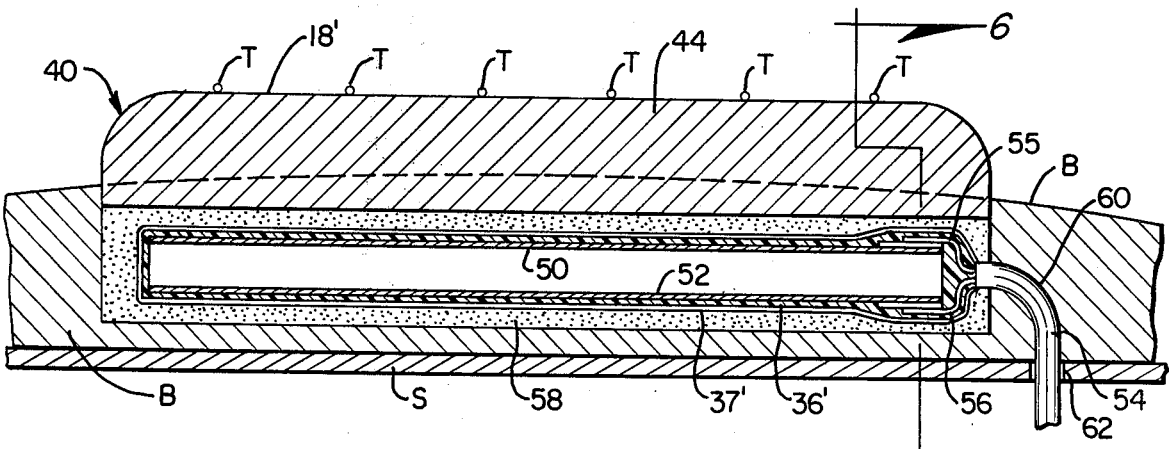
FIG. 7 is a longitudinal section view of the embodiment shown in FIG. 5.

Another single dimensional saddle construction is illustrated in FIGS. 5 to 7 in which like parts are correspondingly enumerated to that of FIGS. 1 to 4. In the alternate form, once again a saddle member 40 is formed with a transducer 41 positioned in a cavity 42 of the saddle, the saddle being formed to be of a size corresponding to the bridge slot L of the stringed instrument. Saddle 40 is defined by an elongated rigid member having an upper string support surface 18' corresponding to the configuration of the string support surface 18 of the preferred form and the body 44 of the saddle has a pair of spaced-apart, parallel wings or sides 46 projecting in a common direction away from the body 44 to form the cavity or channel 42 for insertion of the transducer. To this end, the body 44 may be composed of any suitable material such as bone, aluminum, carbon graphite as previously described in connection with more conventional saddle constructions for guitars.

In turn, the transducer 41 is formed of a single bar 48 which is of generally rectangular cross-section and composed of a crystalline material such as lead/zirconate-lead/titanate or barrium titanate. The bar 48 has a first electrical terminal or electrode surface 50 and a second electrical terminal or electrode 52 formed on opposite top and bottom surfaces of the bar, each electrode forming either a positive or negative electrical terminal according to the orientation of the lattice of the crystalline material comprising the bar. A shielded cable 54 has a lead wire 55 with a shielding wire 57, the lead wire 55 being connected to the positive terminal 50, and the shielding wire 57 being connected to the negative terminal 52 serving to isolate the transducer 41 as hereinafter described.

The transducer 41 is covered with an insulating layer 36' corresponding to the insulating layer 36 of the preferred form and, after scraping the negative lead wire until bare, a second or outer conductive coating or layer 37' is applied so as to cover the insulating layer 36 and corresponds to the outer conductive layer 37 of the preferred form. The outer conductive coating layer 37' cooperates with the shielding wire 57 in completely shielding the transducer 41 from external electromagnetic fields. However, the outer coating layer 37' may be eliminated when the body 44 is formed of a conductive material which is connected to ground. Moreover, when conductive material is employed in the body 44, it is desirable to pot the insulated transducer 41 within a layer of conductive epoxy 58 which is placed within the cavity or channel 42 so that the layer 58 not only bonds the saddle body 44 and transducer 41 together but also forms the contact connecting the saddle to ground. If metal strings are employed, by grounding the saddle as described, the strings will also act as an additional shielding means. In forming the alternate embodiment of the saddle 40, again the lead wire 55 may be soldered to the electrode 50 and shield wire 57 soldered to electrode 52. The entire transducer assembly is dipped in an insulating liquid epoxy and allowed to dry to form the insulating layer 36' as described in the preferred form. It is important that the insulating layer cover the electrical contacts 50 and 52 as well as the entire bar and the lead wire 55. After drying the assembly is then dipped into a conductive paint in forming the outer conductive layer 37', as described in the preferred form, which will completely encapsulate the transducer assembly. Again the shielding wire 57 is electrically connected to the conductive coating 37' and provides a ground for the electrical circuit containing the transducer.

Once the transducer is mounted in the cavity 42 in the manner described, the completed saddle 40 is then bonded in the slot L which is formed in the bridge B. A bore 60 is formed in the bridge and a corresponding hole 62 formed in the soundboard to define a groove or passageway for the cable; or if desired the cable may merely be extended around the end of the saddle so as to exit from the bridge on a side opposite to the soundboard S. The cable is then connected to an external amplifier, not shown, such as by means of a standard female connector attached to the sidewall of the guitar and may be the conventional banana plug connector so that a patch cord may interconnect the guitar and amplifier.

In the forms of invention as described both have been found to be highly sensitive to the major components of vibratory motion created when the instrument strings are plucked or otherwise activated. As each string vibrates, the saddle vibrates correspondingly. Where several string are plucked simultaneously, the saddle vibrates as a superposition of these vibrations which are usually at different frequencies. By mounting the transducer internally of the saddle, the transducer is caused to vibrate with the saddle so as generate electrical oscillations corresponding to the components of the vibratory stress occurring in the direction of crystal polarization. Because the transducer subtends or underlies the strings, these major components are substantially the same as the frequency pattern of the vibrating strings. In addition, secondary vibrations resulting from the acoustic circuit of the instrument affect the motion of the instrument soundboard S and hence the bridge B. This in turn interacts with the vibrating saddle so that the transducer is affected by these secondary resonances but to a lesser degree than those vibrations generated by the strings. The summed electrical signal generated by the entire set of vibratory motion of the instrument in its acoustic circuit has been found to greatly enhance the tonal qualities for electronic amplification.

DETAILED DESCRIPTION OF TWO-DIMENSIONAL EMBODIMENT

Figure 9:
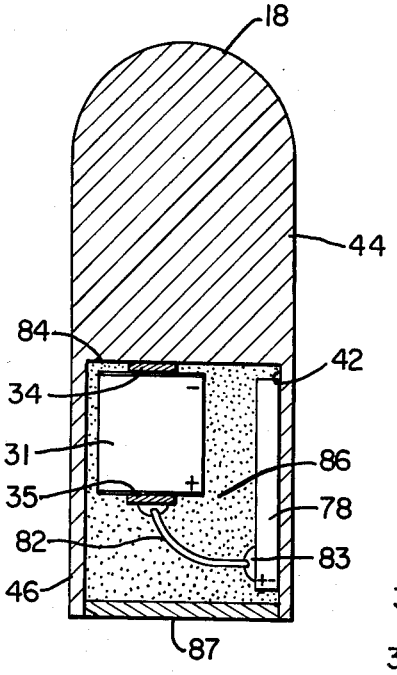
FIG. 9 is a cross-sectional view of the two-dimensional embodiment shown in FIG. 8.
Figure 8:
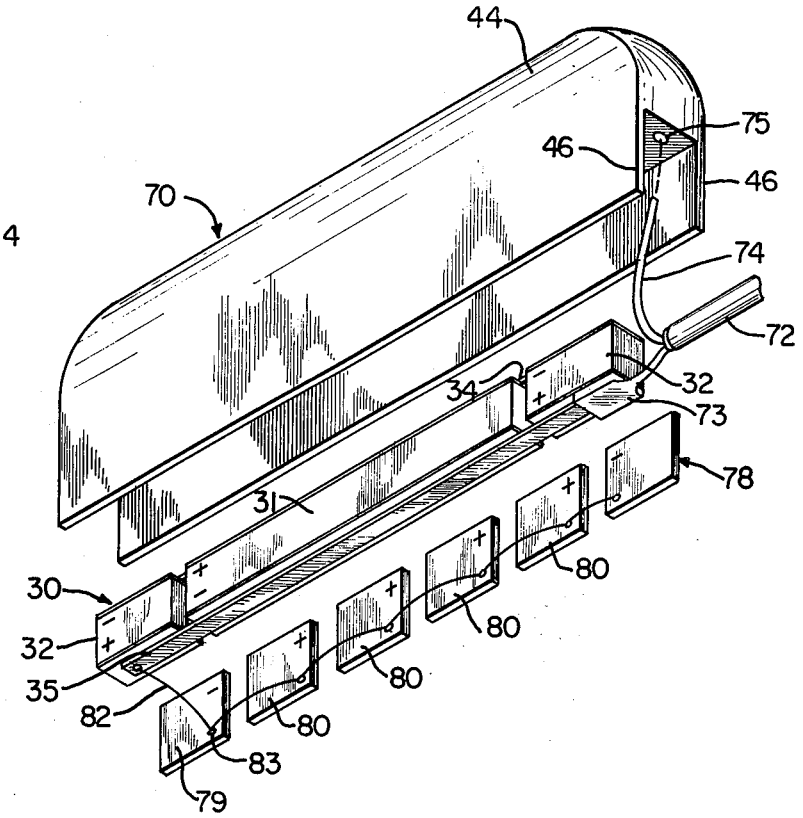
FIG. 8 is an exploded perspective view of still another embodiment of the present invention employing a two-dimensional transducer.

There is illustrated in FIGS. 8 and 9 a modified form of the present invention which is characterized by being responsive to vibrations in two dimensions so as to improve the amplified tonal quality of an instrument. Specifically, saddle 70 corresponds in size and configuration to the generally U-shaped saddle 40 described in the alternate form of FIGS. 5 to 7; however, in FIGS. 8 and 9, the saddle 70 has a body 44 composed of a carbon graphite material which is molded into a generally U-shaped configuration as shown to define an upper string supporting surface 18', a central channel or cavity 42 flanked by opposite sides 46.

A transducer assembly for the two-dimensional form is broadly comprised of a bar member or assembly 30 corresponding to that of the preferred form of FIGS. 1 to 4 in which end bar segments 32 are of opposite polarity to the intermediate bar segments 31 and shim contact strips 34 and 35 extend along opposite top and bottom surfaces, respectively of the bar. A coaxial cable 72 has a positive lead wire 73 connected to one end of the contact strip 35 and a negative lead wire 74 which also serves as a shielding wire and extends into an aperture 75 in the body 44 of the saddle. In addition the transducer assembly includes a plurality of piezoelectric crystal plates 78 arranged in longitudinally spaced, end-to-end relation along the inner surface of one of the sidewalls 46 of the channel 42. Each plate has a pair of electrodes or electrical contacts 79 and 80 on opposed flat surfaces which are of opposite polarity to one another; and as shown, the polarity of the wafer-like crystals 78 is arranged such that a pair of the crystals at opposite ends of the channel have negative electrodes facing inwardly toward the bar assembly 30 and a series of four of the intermediate crystals have electrodes of positive polarity facing inwardly toward the bar assembly 30. The lead wire 82 extends from the contact strip 35 to a terminal 83 on the first plate then extends continuously along the remaining plates so as to interconnect the plates in series to one another and to the bar assembly.

The lead wire 82 defines a positive terminal connection from the crystal plates 78 through the bar assembly to the positive lead 73. Most desirably, the plates are adhered to the sidewall 46 of the channel by conductive coating such as a Hysol R82038 with 20% copper powder layer applied to the interface between the plates and the sidewall; and another conductive layer 84 is applied between the bar assembly 30 and bottom wall of the channel 42. Once the transducer assembly is inserted and arranged in the manner described within the channel, the balance of the space within the channel is filled with a non-conductive epoxy material 86 such as Hysol C94210-HD3561; and another layer of conductive epoxy material 87 is applied across the lower open end of the channel so as to completely encapsulate the elements within the cavity or channel 42.

In the conductive saddle assembly as described, the formation of the body of the saddle out of a conductive material operates as a shield for the transducer assembly. The resultant electrical pickup has been found to be extremely quiet yet sensitive and exhibits an excellent signal-to-noise ratio. By arranging the polarization of the crystal plates 78 orthogonal to that of the bar assembly 30, two components of vibratory motion may be sensed by the set of transducers. In conventional systems, the transducer assemblies are not ordinarily capable of responding to more than one plane of vibration of a string and respond more to vertical vibrations. In the two-dimensional form of invention, it is desirable to amplify the sounds of the instrument to produce electrical signals corresponding to as many planes of vibration of the instrument strings as possible. Furthermore, by alternating the polarity of the crystal plates 78, undesirable sounds created by the playing of the instrument are minimized. Otherwise, if all the transducers were to be mounted with a common polarity, it would become unduly sensitive to vibrations of the soundboard such as those caused by inadvertently tapping or thumping the board. In addition, as the player advances his fingers along the strings while compressing the strings against the instrument high frequency vibrations can be set up in the soundboard or string known as finger squeaks. Undesirable amplification of soundboard noises can be substantially reduced by reversing the polarity of the outermost plates of the transducer since the reverse polarity will cause signals generated by vibration of the soundboard to be 180° out of phase and the resultant signals from these transducer plates will essentially negate or cancel one another. However, for a vibration of a given string its corresponding crystal plate is more intensely vibrated than adjacent transducers to avoid any detrimental interference therebetween. Thus, since adjacent strings are tuned to different frequencies, even when adjacent strings are simultaneously vibrated, the signals generated through the transducers do not tend to cancel each other out.

With respect to all of the embodiments according to the present invention, it should be appreciated that an integral structure is achieved wherein the transducer forms a physical portion of the saddle member which may then be inserted into the bridge in a conventional manner. By so doing, undesired damping is eliminated since there are no elastic or cantilever members which interact with the vibration of the string to alter each string's vibrational modes. This construction also eliminates the need for an independent inertial mass against which the transducer vibrates. In this manner, the transducer of the present invention is acoustically passive so that it does not affect the tonal qualities of the acoustic instrument.

Although the present invention has been described with particularity relative to the foregoing detailed description of the preferred embodiment, various modifications, changes, additions and applications other than those specifically mentioned herein will be readily apparent to those having normal skill in the art without departing from the spirit and scope of this invention.

I claim:

1. In a stringed instrument having a soundboard and a bridge portion over which a plurality of strings are passed, a piezoelectric saddle comprising:

an elongated body provided with an upper string support surface and an internal cavity extending the length of said body, means adapted for securing said body to said bridge portion with the length of said body aligned in a direction transversely of said strings;

an elongated piezoelectric transducer member extending through the internal cavity in said body and in a direction parallel to the length of said body, said transducer member subtending said strings, said elongated piezoelectric transducer member defining a first transducer extending through the internal cavity in a direction parallel to the length of said body, and a second transducer extending in spaced parallel relation to said first transducer along the length of said internal body, and electrically conductive lead interconnecting positive terminals of said first and second transducers, and means grounding said first and second transducers through said saddle;

electrode members disposed in spaced relation to one another on parallel surfaces of said transducer member such that said terminals are of opposite polarity, and electrical leads extending from said electrodes members; and means encasing said transducer member within said body and integrating said transducer and said body into a unitary elongated, rigid member.

2. In a stringed instrument according to claim 1, said securing means defined by a slot in said bridge portion into which said body is inserted.

3. In a stringed instrument according to claim 1, said internal cavity being defined by a slotted portion of inverted, generally U-shaped configuration.

4. In a stringed instrument according to claim 1, said transducers being in the form of ceramic bars each having an elongated crystalline lattice structure oriented in a direction to establish opposite polarity on opposed parallel surfaces of said transducer member.

5. In a stringed instrument according to claim 1, said saddle including shielding means defined by a curable plastic resin forming a rigid mass in outer surrounding relation to said transducer member.

6. In a stringed instrument according to claim 1, said first transducer being in the form of a crystalline bar having a depth greater than its cross-sectional thickness in the direction of extension of said strings, the upper surface of said bar being under compression and the lower surface of said bar being under tension when at least one of said strings is vibrated, said terminals being positioned at one end of said bar on the upper and lower surfaces thereof so as to be of opposite polarity.

7. In a stringed instrument according to claim 1, including an inner layer of electrical insulating material surrounding said first transducer and an outer layer of an electrically conductive material, said outer layer defining a radiofrequency shield for said first transducer.

8. In a stringed instrument according to claim 1, said body being composed of an electrically conductive material which is grounded, and shielding means being defined by an adhesive, electrically insulative material in surrounding relation to said transducer member.

9. In a stringed instrument having a soundboard and a bridge portion over which a plurality of strings are passed, a piezoelectric saddle comprising:

an elongated body provided with an upper string support surface and an internal cavity extending the length of said body, means adapted for securing said body to said bridge portion with the length of said body aligned in a direction transversely of said strings;

an elongated piezoelectric transducer member extending through the internal cavity in said body, said elongated piezoelectric transducer member defining a first transducer extending through the internal cavity in a direction parallel to the length of said body, and a second transducer defined by at least one piezoelectric plate extending in spaced parallel relation to said first transducer along the length of said internal body, an electrically conductive lead interconnecting positive terminals of said first and second transducers, and means grounding the negative terminals of said first and second transducers through said saddle;

electrode members disposed in spaced relation to one another on parallel surfaces of said transducer member such that said terminals are of opposite polarity, and electrical leads extending from said electrode members; and means encasing said transducer member within said body and integrating said transducer member and said body into a unitary elongated, rigid member.

10. In a stringed instrument according to claim 9, said second transducer member being defined by a plurality of piezoelectric transducer elements extending in longitudinally spaced relation to one another, each of said piezoelectric elements underlying one of said strings and being electrically interconnected such that the electrical signals generated in response to vibration of one of said string members is out of phase with the electrical signal generated by adjacent piezoelectric elements.

11. In a stringed instrument according to claim 10, said second transducer member being disposed along a wall surface of said internal cavity in adjacent but spaced relation to said first transducer member.

12. In a piezoelectric saddle for a stringed instrument, a transducer comprising an elongated polarized ceramic bar assembly having at least one intermediate bar segment including electrodes on opposed parallel surfaces, said electrodes being of opposite polarity to one another, and end bar segments at opposite ends of said intermediate bar segment including electrodes of opposite polarity to one another on opposed parallel surfaces, the polarity of said electrodes on said end bar segments being reversed with respect to the polarity of said electrodes on said intermediate bar segment, and means interconnecting said intermediate and end bar segments in closely-spaced end-to-end relation to one another.

13. In a piezoelectric saddle according to claim 12, said intermediate and end bar segments being of generally rectangular cross-section, said electrodes disposed on flat parallel surfaces extending perpendicular to the ends of said intermediate and end bar segments.

14. In a piezoelectric saddle according to claim 12, said interconnecting means being defined by electrical contact members extending continuously along opposed parallel surfaces of said end bar and intermediate bar segments.

15. In a piezoelectric saddle according to claim 14, there being a pair of electrical contact members disposed in superimposed relation to said electrodes on said intermediate and end bar segments, the aggregate length of said intermediate and end bar segments being substantially equal to the distance between outermost strings of said stringed instruments at the point of passage of said strings over a bridge of the stringed instrument.

16. In a piezoelectric saddle according to claim 12, said transducer including an outer insulating layer in surrounding relation to said electrodes and bar segments.

17. In a piezoelectric saddle according to claim 16, including a shielding layer in outer surrounding relation to said insulating layer.

18. In a piezoelectric saddle according to claim 12, said transducer including a plurality of wafer-like piezoelectric plates arranged in end-to-end relation to one another and in spaced parallel relation to said bar segments.

19. In a piezoelectric saddle according to claim 18, said wafer-like plates having planar surface portions in facing relation to said intermediate and end bar segments including planar surface portions at opposite ends of said wafer-like plates of the same polarity and the planar surface portions of intermediate plates being of opposite polarity to said end plates, and electrical connecting means interconnecting one of said electrodes on one of said end bar segments with a planar surface portion on one of said end plates.

20. In a piezoelectric saddle according to claim 19, said electrical connecting means connecting a positive electrode on one of said end bar segments with a planar surface portion of positive polarity, and an electrical conductor including a positive lead bar connected to said electrode of positive polarity on one of said end bar segments and a negative lead wire connected to ground.

21. A piezoelectric saddle accessory for stringed instruments comprising:

a transducer including an elongated polarized ceramic bar assembly having an intermediate bar segment provided with electrodes on opposed parallel surfaces which are of opposite polarity to one another and end bar segments at opposite ends of said intermediate bar segment provided with electrodes of opposite polarity to one another on opposed parallel surfaces aligned with opposed parallel surfaces of said intermediate bar segment, the polarity of said electrodes on said end bar segments being reversed with respect to the polarity of said electrodes on said intermediate bar segment, and electrical contact means interconnecting respective electrodes of one polarity on said intermediate bar segment with respective electrodes of opposite polarity on said end bar segments;

a layer of electrical insulating material disposed in surrounding relation to said electrodes and bar segments and an outer layer in surrounding relation to said insulating layer defining a radio frequency shield for said transducer; and an outer body disposed in outer surrounding relation to said transducer and an electrical conductor having positive and negative lead wires.

22. In a piezoelectric saddle accessory according to claim 21, said outer body being composed of an epoxy material encapsulating said transducer.

23. In a piezoelectric saddle accessory according to claim 21, said outer body being in the form of an elongated rigid member providing an upper string support surface extending in a direction parallel to said transducer and provided with a cavity adjacent to its lower end extending parallel to said string support surface and adapted for positioning of said transducer therein.

24. In a piezoelectric saddle accessory according to claim 21, said intermediate and end bar segments being of generally rectangular cross-section and composed of a piezoelectric crystalline material.

* * * * *

UNITED STATES PATENT AND TRADEMARK OFFICE

CERTIFICATE OF CORRECTION

PATENT NO. : 4,314,495

DATED : February 9, 1982

INVENTOR(S) : Lloyd R. Baggs

It is certified that error appears in the above—identified patent and that said Letters Patent is hereby corrected as shown below:

Column 6, line 43, cancel "410.025" and substitute -- 0.025 --.

IN THE CLAIMS:

Claim 1, Column 10, line 51, cancel "and" and substitute -- an --.

Signed and Sealed this

*Twentieth* Day of *July 1982*

[SEAL]

*Attest:*

GERALD J. MOSSINGHOFF

*Attesting Officer*

*Commissioner of Patents and Trademarks*